US007797871B2

(12) United States Patent
Bubits

(10) Patent No.: US 7,797,871 B2
(45) Date of Patent: Sep. 21, 2010

(54) MAGAZINE FOR A FIREARM

(75) Inventor: Wilhelm Bubits, Brunn/Gebirge (AT)

(73) Assignee: Caracal International LLC, Abu Dhabi (AE)

( * ) Notice: Subject to any disclaimer, the term of this patent is extended or adjusted under 35 U.S.C. 154(b) by 824 days.

(21) Appl. No.: 10/587,070

(22) PCT Filed: Feb. 7, 2005

(86) PCT No.: PCT/IB2005/000292

§ 371 (c)(1),
(2), (4) Date: Apr. 19, 2007

(87) PCT Pub. No.: WO2005/075929

PCT Pub. Date: Aug. 18, 2005

(65) Prior Publication Data

US 2008/0028661 A1 Feb. 7, 2008

(30) Foreign Application Priority Data

Feb. 9, 2004 (AT) ..... A 186/2004

(51) Int. Cl.
*F41A 9/65* (2006.01)
*F41A 9/71* (2006.01)

(52) U.S. Cl. ..... 42/49.01

(58) Field of Classification Search ..... 42/49.01–50
See application file for complete search history.

(56) References Cited

U.S. PATENT DOCUMENTS

| | | | | | |
|---|---|---|---|---|---|
| 274,715 | A * | 3/1883 | Buckley | ..... | 267/180 |
| 4,107,862 | A * | 8/1978 | Sofinowski, III | ..... | 42/50 |
| 4,397,453 | A * | 8/1983 | Seecamp | ..... | 267/166.1 |
| 5,167,304 | A * | 12/1992 | Capek | ..... | 188/325 |
| 5,438,783 | A * | 8/1995 | Sniezak et al. | ..... | 42/7 |
| 6,481,701 | B2 * | 11/2002 | Kessen et al. | ..... | 267/166 |

* cited by examiner

*Primary Examiner*—Troy Chambers
(74) *Attorney, Agent, or Firm*—Greer, Burns & Crain, Ltd.

(57) ABSTRACT

A magazine for improved stacking capacity includes a housing, a front wall connected to a back wall by sidewalls, a base, a spring adapted to be received inside a recess in the base in order to reduce the space occupied by the spring. The spring having various spiral sections wherein the spiral section having different lengths so that the spiral sections fit into each other when the spring is compressed against cartridges in order to enable stacking of additional cartridges.

14 Claims, 3 Drawing Sheets

MAGAZINE FOR A FIREARM

FIELD OF THE INVENTION

The invention relates to a magazine for a firearm, and in particular a magazine with expanded capacity for holding cartridges.

DESCRIPTION OF THE RELATED ART

Those skilled in the art have long appreciated the importance of ammunition magazines. A magazine stores a number of cartridges and sequentially feeds them into a firing position within the firearm. A significant feature of a magazine is its storage capacity of cartridges.

Usually a magazine is designed as a cavity into which the cartridges are arranged sideways in a row. A tensile pressure is exerted upon the row by means of a spring that advances the array of cartridges further as the empty cavity of each fired cartridge is discarded.

Prior magazines typically include a housing that has a front wall, back wall, sidewalls and a base. The housing has spring forming spirals mounted inside the housing. Each spiral has about the same length of other spirals. When the spring is compressed by the weight of the cartridges, the spirals do not fit inside each other. The compressed spring squanders a space that can be utilized to store additional cartridges.

The spring is attached to the base by an insert piece. The base piece is slideable within tracks inside the walls of the housing. In order to secure the base to the housing, a pin mounted on the outside surface of the base fastens the base to the housing. If the pin is pressed by a screwdriver or like tool, the pin is released and the base becomes separated from the housing.

In the case of firearms, the magazine is situated as a rod-magazine inside the handle, whereby the length of the magazine is limited. One strives to store a maximum of cartridges in this limited length. For that reason, magazines are mostly designed to take cartridges in two rows, offset against each other, which then come together at the top end.

One particular disadvantage with prior art magazines is the amount of space needed to accommodate the spring and the insert piece.

Another disadvantage is that the prior art magazine is difficult to assemble and disassemble.

Another disadvantage is that there are many parts that are susceptible to malfunction.

OBJECTS OF THE INVENTION

It is an object of this invention to provide a magazine with an improved storage capacity for cartridges.

An additional object of the invention is to provide a magazine that can be easily assembled and disassembled.

A still further object of the invention is to provide a magazine with few moving parts to minimize the possibility of malfunction during use of the firearm.

SUMMARY OF THE INVENTION

The above-listed objects are met or exceeded by the present magazine for a pistol or other firearm that comprises a housing having a front wall, a back wall and side walls, and a base. A spring is mounted inside the housing and adapted to receive a cartridge. The spring is biased against the cartridge, the spring being of a generally spiral shape terminating with a downward bent section and adapted to be received in a recess in the base. A loader is mounted inside the housing and operatively connected to the spring for enabling stacking and operatively positioning of the cartridges.

DETAILED DESCRIPTION OF PREFERRED EMBODIMENTS

Figure 1:
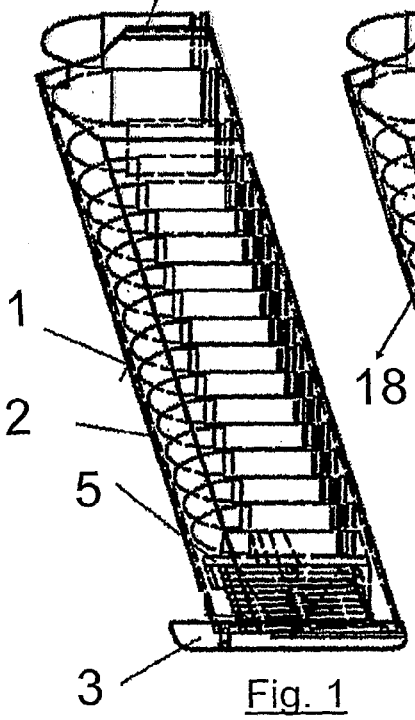
FIG. 1 illustrates an elevational view of a prior art magazine with portions shown cut away.

A prior art magazine is shown in FIG. 1, the conventional magazine 1 is comprised of a housing 2 that rests on a base 3. The prior art magazine 1 is shown stacked with cartridges 4 that press a loader or follower 5 that compresses a spring 6. The spring 6 occupies a significant space inside the housing 2 of the conventional magazine 1.

Figure 6:
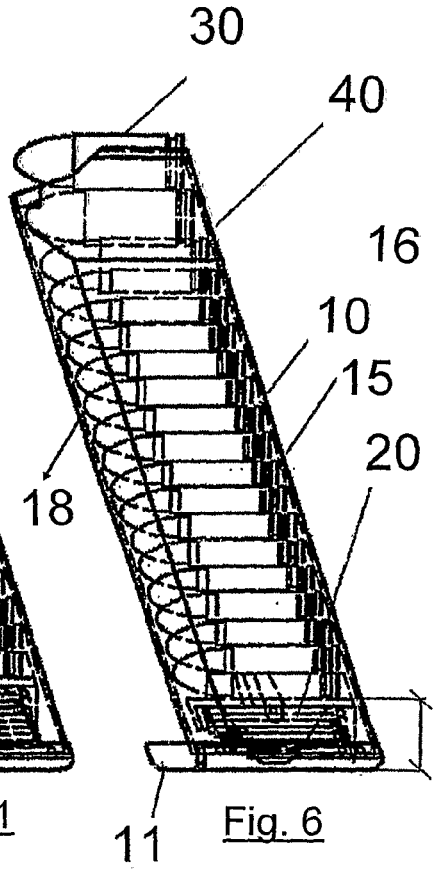
FIG. 6 illustrates an elevational view of the present invention a preferred embodiment of the magazine with portions shown cut away.
Figure 2:
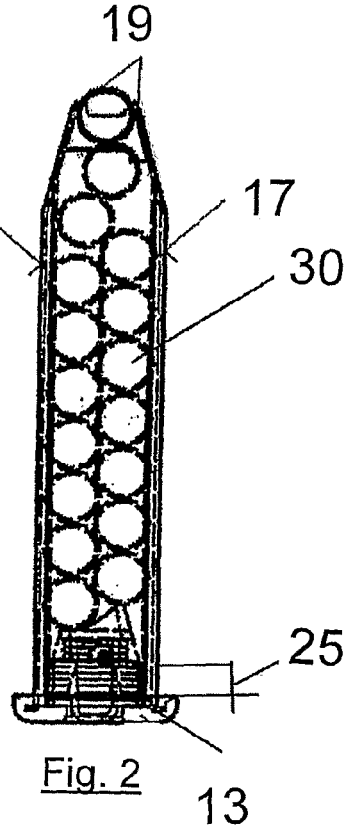
FIG. 2 illustrates a rear view of a preferred embodiment of the present invention of a magazine showing bullets being stacked inside the housing.

The present invention magazine is shown in FIG. 2, the magazine 40 is comprised of a housing 10 that includes a front wall 18, shown in FIG. 6, connected by side walls 16 and 17, to a back wall 15, shown in FIG. 6. The sidewalls 16 and 17 terminate with lips 19, which is insertable into a cartridge chamber of a firearm, which is not shown here. The housing 10 rests on a slideable base 11. FIG. 1 shows the magazine 40 stacked with cartridges 30. The cartridges 30 press a plate-like loader 29, which in turn compresses a spring 20 beneath it. The loader 29 enables stacking of cartridges 30 inside the housing 10 and operationally positioning the cartridges 30 for discharging. The structure and function of the loader 29 are well known to those skilled in the art.

The housing 10 terminates with a slideable track 13A slideable inside track guide 13 mounted inside the base 11. The U-shaped downward bent section 24 of spring 20 fits inside the base 11. The spring 20 occupies minimum space inside the housing 10 because the spring is not entirely mounted on top of the base 11, but rather has a downward bent section 24 that dips down inside the base 11. The extra space provided by the downward section 24 can be utilized to stack additional three or more bullets, compared to conventional magazine.

Figure 3:
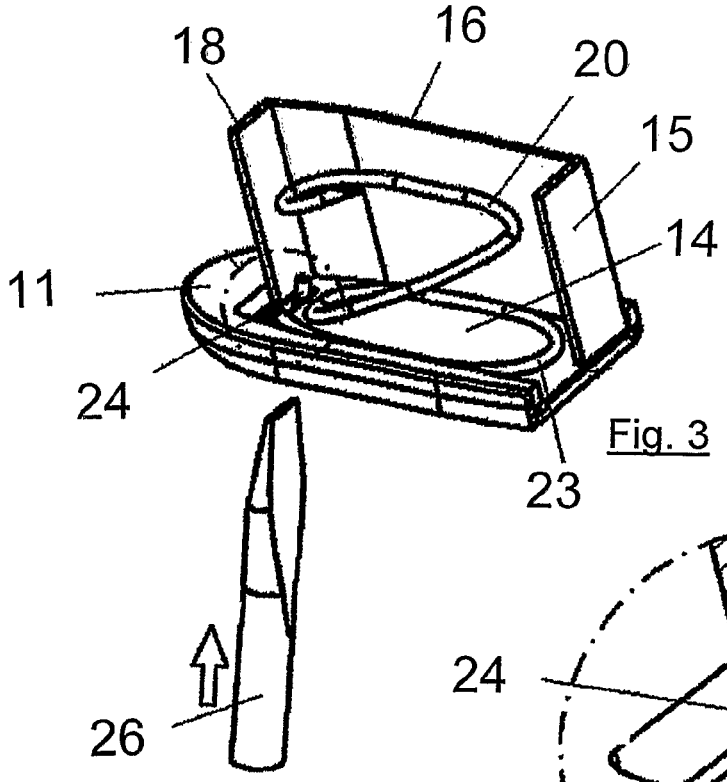
FIG. 3 is an exploded view of the present invention showing the downward bent section of the spring fit inside a recess in the base.

Referring now to FIG. 3, the spring 20 includes a plurality of spirals, the lowest or third section of the spiral 23 is shown here resting partially on the surface 14 of the base 11 wherein the third section terminates with U-shaped like downward bent section 24 that fits entirely into a recess 12 inside the base 11. One advantage provided by the present magazine is reducing the space squandered by the spring 20 by having a portion of the spring 20 fits inside the base 11. Another advantage provided by the present magazine is that the downward bent section 24 secures the base 11 by preventing the slideable base 11 from sliding out of its position via track guides 13. The bent section 24 can be made into different designs and shapes by those skilled in the art, depending on the application.

Figure 4:
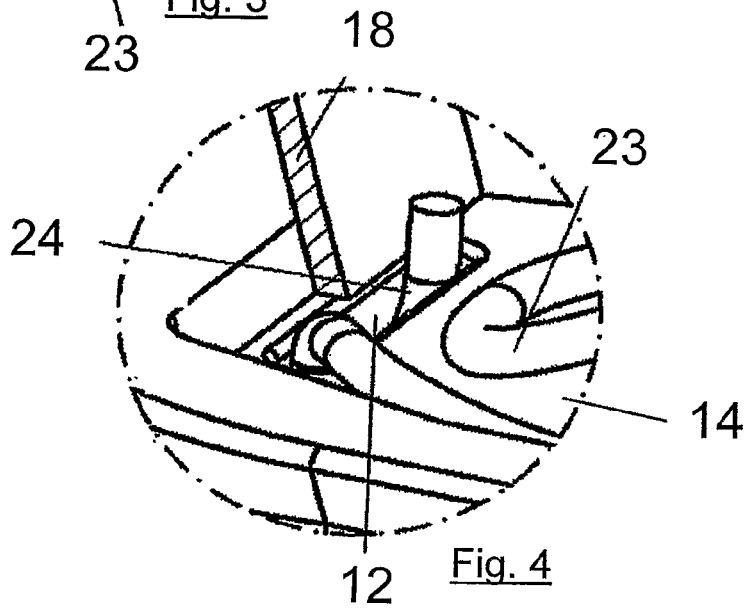
FIG. 4 is a detailed view of the present invention showing the downward bent section of the spring.

Referring now to FIG. 4, the downward bent section 24 of the spring 20 fits entirely inside the recess 12 inside the base 11. A portion of the lowest spiral third section 23 is shown resting on the surface 14 of the base 11.

Figure 5:
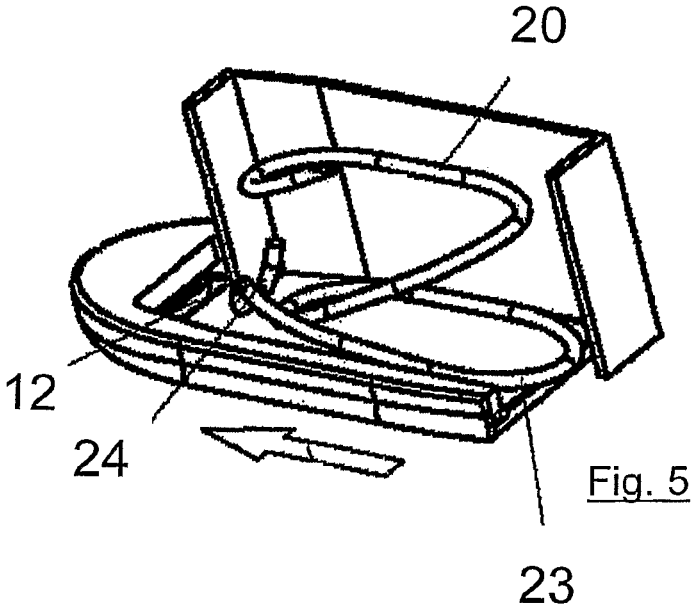
FIG. 5 is another exploded view of the present invention showing the downward bent section of the spring unlocked.

Referring now to FIGS. 3 and 5, the magazine 40 can be easily disassembled by applying a tool, such as a screwdriver 26, to the downward bent section 24 forcing it to leave the recess 12 of the base 11 and thereby releasing the spring 20. The base 11 can then easily slide out by pulling it apart from the housing 10 as shown in FIG. 5.

Figure 7:
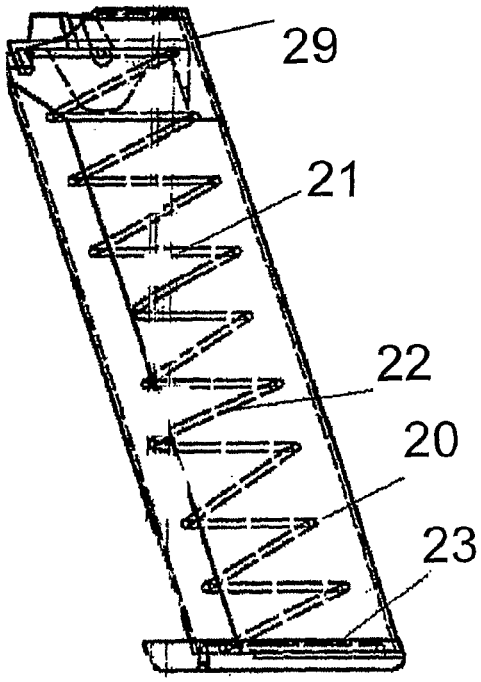
FIG. 7 is an elevational view of the present invention showing details of the spring mounted inside the housing of a preferred embodiment.
Figure 8:
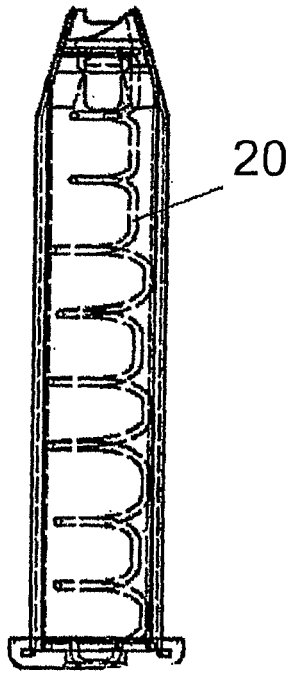
FIG. 8 is a rear detailed view of the present invention of a spring of FIG. 7.

Referring now to a second preferred embodiment in FIGS. 6 and 7, the spring 20 is very compressed and occupies a small space in the housing 10, compared to the space occupied by the conventional magazine spring 6 shown in FIG. 1. More cartridges 30 can be stacked inside the present invention magazine 40 with the use of the spring 20.

Referring now specifically to FIG. 7, the spring 20 generally includes about three spiral sections, a first section 21, a second section 22 and a last or third section 23. All these spiral sections have different and various lengths. When the spring 20 is compressed, it folds into itself because its spiral sections fit into each other.

Figure 9:
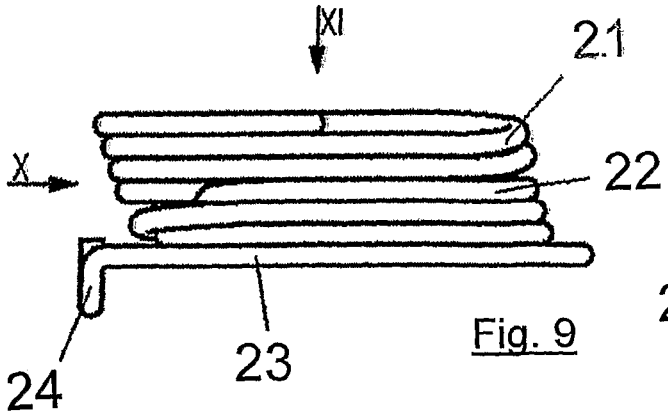
FIG. 9 is a perspective view of the present invention of a spring of FIG. 7 when compressed into itself.
Figure 10:
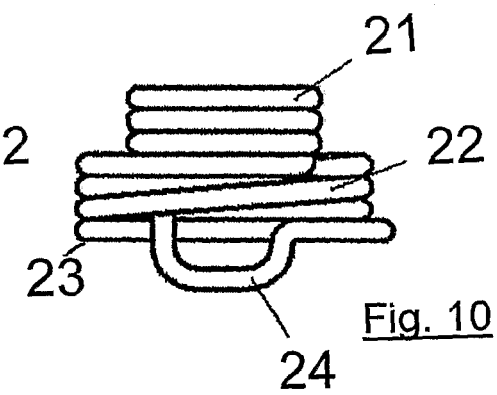
FIG. 10 is a frontal view of the present invention of a compressed spring of FIG. 7.

Referring now to FIGS. 9-12, the different spiral sections 21, 22 and 23 of the spring 20 fit into each other. FIG. 9 shows that when spiral section 21 is compressed it folds onto spiral section 22, which folds onto section 23 that terminates with the bent section 24. FIG. 10 shows first spiral section 21 having different length than the second and third spiral sections 22 and 23 respectively. The various spiral sections, 21, 22 and 23, of spring 20 can fit into each other by virtue of having different lengths.

Figure 11:
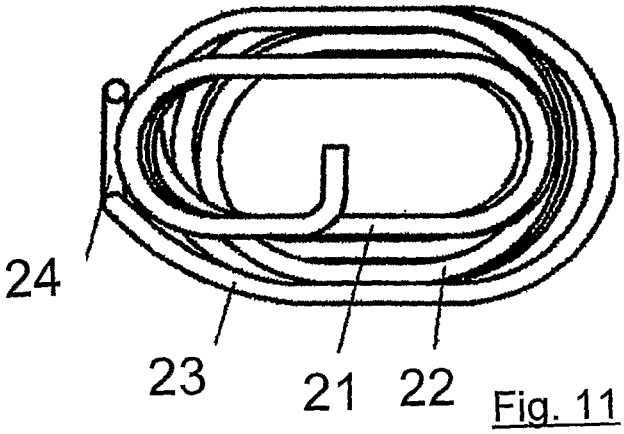
FIG. 11 is a plan view of the present invention of a compressed spring of FIG. 7.

FIG. 11 shows a plan view showing the spring 20 folding and compressing into itself and thereby reducing space occupied by the spring inside the magazine 40 in order to enable stacking of additional cartridges.

Figure 12:
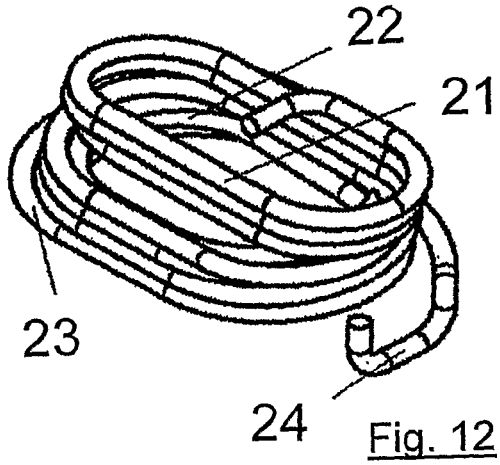
FIG. 12 is another perspective view of the present invention of a compressed spring of FIG. 7.

FIG. 12 shows various spiral sections 21, 22 and 23 of the spring 20 wherein the lowest portion, the third spiral section 23, is preferably the longest spiral section that terminates with the U-shaped like bent section 24.

The invention thus concerns a magazine for a firearm, consisting of a housing 10, a base piece 11 that can be dismantled, a magazine spring 20 and a loader 29, whereby the magazine spring 20 includes a number of spirals, which press the loader 29 upwards.

The basic task of the invention is therefore to improve the known types of magazines to the effect that it can take more cartridges in the same height. Even one or two more cartridges is a considerable tactical advantage. This, according to the invention, can, in a particularly preferred embodiment, be attained by having the lowest spiral 23 of the magazine spring 20 rest directly on the base piece 11 and has a downward bent section 24 which slots into an recess 12 in the slideable base 11. The insert becomes unnecessary and the magazine spring can reach further down, even into the base 11. That means a greater stacking space in the magazine 40 and beside that, a reduction of he number of parts. The base 11 is secured against shifting by the downward bent section 24 of the magazine spring 20 itself. This can, again, be lifted by means of a tool 26 from the outside, enabling the removal of the base 11.

The bent section 24 of the magazine spring 20 is preferably a U-shaped like section 24 of the last spiral 23 of the magazine spring 20. The U-shape bent section 24 protects the surface area 14 on the base 11 and when assembling, it snaps into the recess 12 more easily. In placing the downward bent U-shaped like section 24 at the end of the spring 20, it is neither weakened, nor are its characteristics altered. Further, if the downward bent section 24 of the spring 20 of the magazine 40 lies in a space across the line of fire, the positioning of the base piece 11 is especially exact and reliable.

In a preferred embodiment, the spirals 21,22 and 23 of the magazine spring 20 viewed from above have differing shapes, so that spirals or groups of spirals, when the spring 20 is completely compressed, find space at least partly inside or outside the next spirals or groups of spirals. Each spiral has certain length and thickness. Magazine springs are made of a very stiff spring wire, whose diameter in proportion to the plan view of the spring is very small. Thus, there is greater freedom of design in the variation of the plan view forms of the single spirals or groups of spirals. When the spring 20 is completely compressed, these no longer lie parallel, but at least for part of their length, inside each other. Thus, the height 25 of the magazine spring is considerably shortened, and the clearance of the magazine further increased, especially when the spirals or groups of spirals are foreseen to be of differing forms over the entire length of the magazine spring 20.

The invention claimed is:

1. A magazine for firearm comprising:

(a) a housing having a front wall, a back wall, side walls connecting said front wall to said back wall, and a base member attached to said housing, said base member defining a recess configured to be accessible from outside of said housing;

(b) a follower mounted inside said housing and arranged for carrying a plurality of cartridges;

(c) a spring mounted inside said housing and operatively connected to said follower and adapted to bias the follower, said spring having a generally spiral configuration, said spring including a plurality of spirals that generally fit inside each other when being pressed against said cartridges, said spring resting directly on said base member and terminating in a downwardly bent section that is removably engaged with said recess of said base member.

2. The magazine as set forth in claim 1 wherein said bent section is a U-shaped section.

3. The magazine as set forth in claim 1 wherein said plurality of spirals have different lengths.

4. The magazine as set forth in claim 1, wherein said base member is attached to said housing for sliding movement relative to said housing, and said downwardly bent section of said spring and said recess are located in a plane extending transversely to the direction of sliding movement of said base member.

5. The magazine as set forth in claim 1, wherein said base member is plate-shaped and includes a planar inner support surface that extends to a rear rim of said base member and said recess is adjacent to a front end of said support surface opposite to said rear rim.

6. A magazine for firearm comprising:

(a) a housing having a front wall, a back wall, side walls connecting said front wall to said back wall, and a base member attached to said housing, said base member defining a recess configured to be accessible from outside of said housing;

(b) a spring mounted inside said housing and resting directly on said base member, said spring terminating in a downwardly bent section that is removably engaged with said recess of said base member; and (c) a follower mounted inside said housing and operatively connected to said spring for enabling carrying and operative positioning said cartridges.

7. The magazine as set forth in claim 6 wherein said bent section is a U-shaped section.

8. The magazine as set forth in claim 6 wherein said spring includes a plurality of spirals and wherein said plurality of spirals generally fit inside each other when pressed against said cartridges, said plurality of spirals including a first spiral section, a second spiral section and a third spiral section that terminates with downwardly bent section, and wherein said third spiral section is longer than said first and second sections.

9. The magazine as set forth in claim 8 wherein said third spiral section generally rests on said base member.

10. A magazine for firearm comprising:

(a) a housing having a front wall, a back wall, side walls connecting said front wall to said back wall, and a base member attached to said housing, said base member defining a recess configured to be accessible from outside of said housing;

(b) a spring received within said housing and having an end that is removably engaged with said recess; and (b) a follower mounted inside said housing and adapted to be operatively connected to said spring for enabling carrying and operative positioning of at least one cartridge.

11. The magazine as set forth in claim 10 wherein said spring terminates with a bent section that is removably engaged with said recess of said base member.

12. The magazine as set forth in claim 11 wherein said bent section is a U-shaped section.

13. The magazine as set forth in claim 10 wherein said spring includes a plurality of spirals and wherein said plurality of spirals generally fit inside each other when being pressed against said at least one cartridge.

14. A magazine for firearm comprising:

(a) a housing having a front wall, a back wall, side walls connecting said front wall to said back wall, and a base member attached to said housing, said base member defining a recess configured to be accessible from outside of said housing;

(b) a spring mounted inside said housing including a plurality of spirals, said spring movable between a first extended position and a second retracted position, wherein said spring has a height in said second retracted position less than a sum of the thickness of said plurality of spirals, and wherein said spring terminates with a downwardly bent section that is removably engaged with said recess; and (c) a follower mounted inside said housing and operatively connected to said spring for enabling carrying and operative positioning of said cartridge.

* * * * *